US005226520A

United States Patent [19]

Parker

[11] Patent Number: 5,226,520

[45] Date of Patent: Jul. 13, 1993

[54] COIN DETECTOR SYSTEM

[76] Inventor: Donald O. Parker, 987 Three Mile Rd., Grand Rapids, Mich. 49505

[21] Appl. No.: 694,886

[22] Filed: May 2, 1991

[51] Int. Cl.[5] ..... G07D 5/00

[52] U.S. Cl. ..... 194/317; 73/579

[58] Field of Search ..... 194/317; 73/579; 209/590

[56] References Cited

U.S. PATENT DOCUMENTS

| | | | |
|---|---|---|---|
| Re. 28,827 | 5/1976 | Fougere . | |
| Re. 29,090 | 12/1976 | Fougere . | |
| 2,317,351 | 4/1943 | Andalikiewicz | 194/347 X |
| 2,589,214 | 3/1952 | Andrews . | |
| 3,059,749 | 10/1962 | Zinke . | |
| 3,147,839 | 9/1964 | White, Jr. | 194/317 |
| 3,152,677 | 10/1964 | Phillips . | |
| 3,169,626 | 2/1965 | Miyagawa et al. . | |
| 3,317,016 | 3/1967 | Turillon . | |
| 3,481,443 | 12/1969 | Meloni . | |
| 3,506,103 | 4/1970 | Kockens et al. . | |
| 3,576,244 | 4/1971 | Ptacek . | |
| 3,596,744 | 8/1971 | Chesnokoy . | |
| 3,599,771 | 8/1971 | Hinterstocker . | |
| 3,682,286 | 8/1972 | Prumm . | |
| 3,739,895 | 6/1973 | Fougere et al. . | |
| 3,741,363 | 6/1973 | Hinterstocker . | |
| 3,749,220 | 7/1973 | Taluchi et al. . | |
| 3,796,295 | 3/1974 | Montoliyo et al. . | |
| 3,797,307 | 3/1974 | Johnston . | |
| 3,837,454 | 9/1974 | Joeck . | |
| 3,869,663 | 3/1975 | Tschierse . | |
| 3,870,137 | 3/1975 | Fougere . | |
| 3,901,367 | 8/1975 | Miyazawa . | |
| 3,901,368 | 8/1975 | Klinger . | |
| 3,930,512 | 1/1976 | Woodland . | |
| 3,939,953 | 2/1976 | Miyazawa . | |
| 3,952,851 | 4/1976 | Fougere et al. . | |
| 3,962,627 | 6/1976 | Ptacek et al. . | |
| 3,977,508 | 8/1976 | Baumberger . | |
| 3,980,168 | 9/1976 | Knight et al. . | |
| 4,082,099 | 4/1978 | Iwersen . | |
| 4,084,677 | 4/1978 | Searle et al. . | |
| 4,089,400 | 5/1978 | Gregory, Jr. . | |
| 4,096,933 | 6/1978 | Massa | 194/327 |
| 4,109,774 | 8/1978 | Hayashi . | |
| 4,254,857 | 3/1981 | Levasseur et al. . | |
| 4,298,116 | 11/1981 | Niemeyer . | |
| 4,432,447 | 2/1984 | Tanaka . | |
| 4,437,558 | 3/1984 | Nicholson et al. . | |
| 4,441,602 | 4/1984 | Ostroski et al. . | |
| 4,465,173 | 8/1984 | Domen et al. . | |
| 4,469,213 | 9/1984 | Nicholson et al. . | |
| 4,625,851 | 12/1986 | Johnson et al. | 194/200 |
| 4,848,556 | 7/1989 | Shah et al. | 194/212 |
| 4,884,672 | 12/1989 | Parker | 194/318 |
| 4,895,238 | 1/1990 | Speas | 194/319 |
| 4,989,715 | 2/1991 | Grunig | 194/317 |
| 5,062,518 | 11/1991 | Chitty et al. | 194/317 |

FOREIGN PATENT DOCUMENTS

| | | | |
|---|---|---|---|
| 645201A | 9/1984 | Switzerland . | |
| 656240A | 6/1986 | Switzerland . | |
| 633044 | 11/1978 | U.S.S.R. | 194/317 |
| 1582847 | 1/1981 | United Kingdom . | |
| 2069211 | 8/1981 | United Kingdom . | |
| 1604536 | 12/1981 | United Kingdom . | |
| 2200778 | 8/1988 | United Kingdom . | |
| 2215505 | 9/1989 | United Kingdom | 194/317 |

*Primary Examiner*—F. J. Bartuska

*Attorney, Agent, or Firm*—Price, Heneveld, Cooper, DeWitt & Litton

[57] ABSTRACT

An electronically controlled coin tester which generates an audio frequency response in a coin to be tested, then electronically analyzes the response to determine if it matches the characteristic response of an acceptable coin. The audio frequency response is generated by a striker which mechanically impacts the coin as it traverses the coin chute. The striker may be deflectable so that it is deflected from the path of coin travel after it performs its function. Gating is provided to enable the detector circuitry only in the presence of a coin, thereby reducing the susceptibility to tampering. Signal processing circuitry, which can store a plurality of responses relating to a plurality of acceptable coins, makes a comparison with a sampled characteristic to determine if the tested coin is acceptable or should be rejected.

39 Claims, 5 Drawing Sheets

COIN DETECTOR SYSTEM

FIELD OF THE INVENTION

This invention relates to coin testing devices, and more particularly to an improved electronically controlled coin tester.

BACKGROUND OF THE INVENTION

There are many types of coin operated devices, and almost as many ways to attempt to cheat them. Most commonly, slugs or other cheaply manufactured "coins" are used to mimic the tested characteristics of acceptable coins. The problem can be particularly acute in casinos where coin operated gaming devices, such as slot machines, are configured to operate on relatively expensive tokens which are manufactured by the casino, not minted by the government. The metal content and other characteristics of the tokens can vary over time, or from casino to casino, and coin testers must be configured to accept the relatively wide range of valid tokens, while rejecting counterfeits. Since the manufacturing cost of the coin or an imitation is substantially less than its assigned casino value, the manufacture distribution or use of counterfeit coins can be very lucrative, and it is not always a simple task to distinguish between manufactured tokens intended to be acceptable and those which are fraudulent. The foregoing case is given as simply one example of the difficulty of distinguishing between acceptable coins and unacceptable counterfeits.

Early mechanical coin testers which functioned on coin size or weight were easily defrauded by slugs intended to mimic the size and weight of the originals. A particularly successful modern coin tester is the electronic device disclosed in Nicholson et al. U.S. Pat. No. 4,469,213. That system relies on comparing the magnetic properties of a sample coin to those of a deposited coin; such system has significant ability to distinguish between acceptable genuine coins and unacceptable counterfeits. However, a number of instances, one of which was in the slot machine casino environment, have rendered that system less than completely effective. That is particularly true in the casino type case where a number of casinos manufacture coins of a given denomination which can be used interchangeably in the machines of the various casinos. Those tokens being relatively inexpensively manufactured tend to wear. In addition, the tokens tend to vary in metal content, in one example tokens comprising a nickel silver alloy varying from 10% to 25% in nickel content. It has been found necessary to "detune" the circuitry of the aforementioned coin tester in order to provide a sufficiently broad response to accept the rather wide range of acceptable coin characteristics. When the system is detuned, it loses a certain amount of its ability to discriminate between acceptable and counterfeit coins.

SUMMARY OF THE INVENTION

In view of the foregoing, it is a general aim of the present invention to provide a coin detector system which is simple to manufacture and maintain but which has a high degree of sensitivity to imitations which are electronically similar to acceptable coins.

In that regard it is an object of the present invention to provide a coin testing device which is highly sensitive, but which uses a non-magnetic characteristic of the coin which is highly discriminatory between acceptable and unacceptable coins.

Further in practicing that aspect of the invention, an object is to provide a coin testing device relying on the audible response or an impacted coin to discriminate between acceptable and unacceptable coins.

According to a particular aspect of the invention, it is an object to provide an audible coin testing device in conjunction with gate circuitry intended to activate the audible device only in the presence of a coin, thereby reducing the possibility for tampering with the device.

According to one detailed aspect of the invention, it is an object to provide a coin testing device capable of storing audible characteristics of a plurality of acceptable coins and which, upon eliciting an audible response from a coin to be tested, compares that response with a stored characteristic to determine acceptability or unacceptability of the tested coin.

In accordance with the invention, there is provided a coin tester for discriminating between acceptable and unacceptable coins as the traverse a coin chute The coin tester comprises a striker for impacting the coin in its traverse of the coin chute to cause a characteristic audio frequency response in the coin. An audio frequency pickup is closely associated with the coin at impact for sensing the audio frequency response and producing a signal relating to that response. Signal processing means then analyzes the signal originated by the pickup to determine the acceptability or unacceptability of the coin which had been impacted by the striker.

In a preferred embodiment, the mechanical configuration of the coin chute, striker and audio frequency pickup causes the striker to impact the coin without deflecting the coin from its travel down the coin chute, and closely associates the pickup with the coin at the point of impact to maximize sensitivity to the audio frequency response of the coin at the expense of sensitivity to extraneous audio frequency noise.

In a preferred embodiment of the invention, gate means are associated with the pickup or signal processing means to render the system sensitive to the audio frequency response only when a coin is in the test zone, thereby to reduce the possibility of tampering with the coin tester.

It is a feature of the invention that tokens having a broad electromagnetic response which had required detuning of electronic coin testers utilizing electromagnetic principles are reliably discriminated from counterfeits by use or audio frequency testing techniques.

It is a feature of a particular implementation of the invention that a plurality of audio frequency response characteristics of a plurality of acceptable coins can be individually stored and available for matching with a generated audio frequency characteristic of a tested coin.

Other objects and advantages will become apparent from the following detailed description when taken in conjunction with the drawings, in which:

While the invention will be described in connection with certain preferred embodiments, there is no intent to limit it to those embodiments. On the contrary, the intent is to cover all alternatives, modifications and equivalents included within the spirit and scope of the invention as defined by the appended claims.

DETAILED DESCRIPTION OF THE PREFERRED EMBODIMENTS

Figure 1:
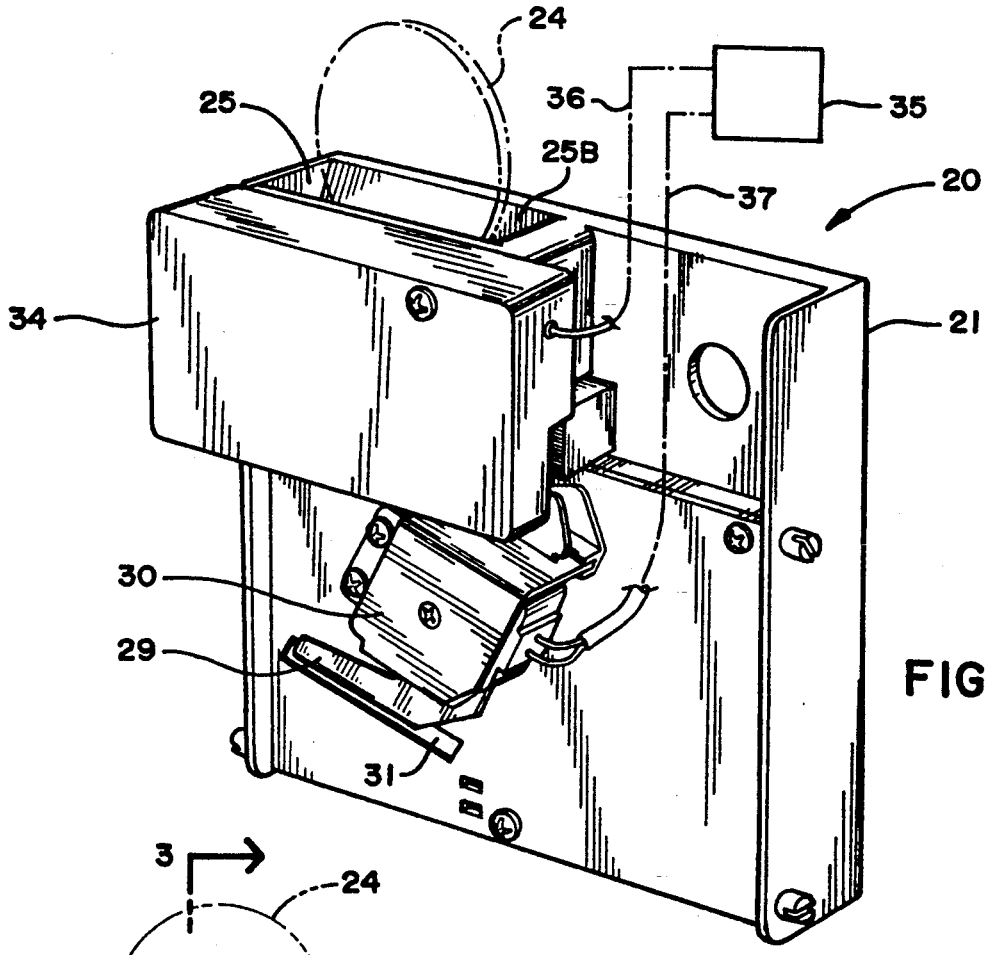
FIG. 1 is a perspective diagram snowing a coin testing device exemplifying the present invention.

Turning now to the drawings, FIG. 1 illustrates the major mechanical elements of a coin tester exemplifying the present invention. The coin tester 20 is shown as being formed on a base plate 21 which is adapted to be fixed to the coin operated machine with which the coin tester is to be associated. A coin chute associated with the coin operated device is adapted to provide a path for traverse of a coin 24 to an entrance 25*b* of the coin chute portion 25 of the coin tester 20 As best shown in FIG. 2, a coin path through the coin tester illustrated by entering coin 24 and exiting coin 26 illustrates a reject path which coins follow when the coin tester 20 determines that those coins are unacceptable A second path identified by entering coin 24 and exiting coin 27 illustates a coin acceptance path into which coins are diverted when the coin tester 20 determines that the coins are acceptable A solenoid 30 which operates a solenoid-driven arm 29 upon detection of an acceptable coin, causes the arm 29 to interrupt the coin path for a coin located in the position illustrated by coin 28, to prevent the coin 28 from following the reject path, and to divert the coin into the acceptance path.

FIG. 1 better shows a slot 31 formed in the base plate 21 to allow the coin deflector arm 29 to be normally withdrawn from the coin path, allowing any coin which enters the coin chute at that time to fall directly through to the reject path. Upon energization of the solenoid 29 as shown in FIG. 3, the arm 29 interposes a projection 29*a* into the coin chute to deflect the coin into the acceptance path.

FIG. 1 illustrates that the electrical and electronic components of the coin testing device are partly mounted in an enclosure 34, and partly disposed on a remote circuit board 35 connected to the electrical elements in the enclosure 34 by means of a cable 36, and to the solenoid 30 by means of a cable 37. The circuit board 35 can, in appropriate circumstances, be mounted on the base plate 21 or, in the more conventional case, be mounted in a more protected area of the coin operated machine somewhat remote from the coin tester, and connected to the coin tester by means of cables 36, 37.

Figure 2:
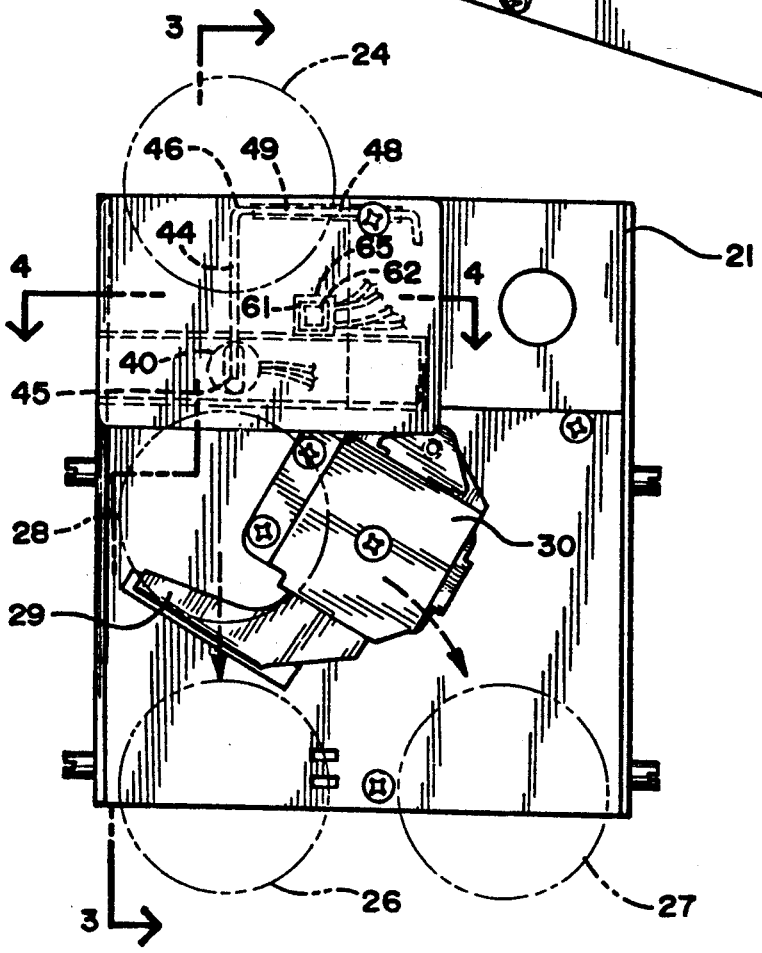
FIG. 2 is an elevation of the device of FIG. 1 showing the coin chute and a coin traversing alternate accept and reject paths.
Figure 3:
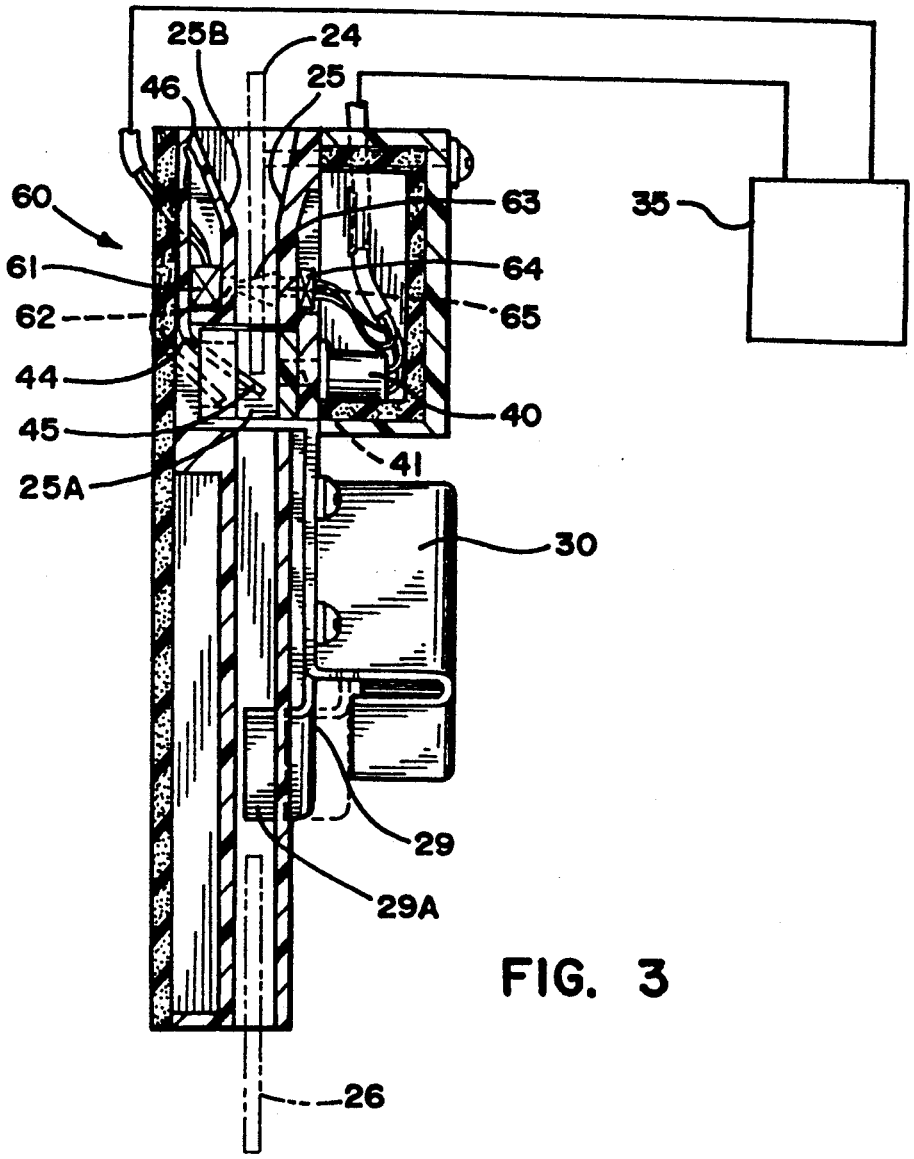
FIG. 3 is a partial sectional view taken along the line 3—3 of FIG. 2 better illustrating the audio frequency sensing elements of the system.
Figure 4:
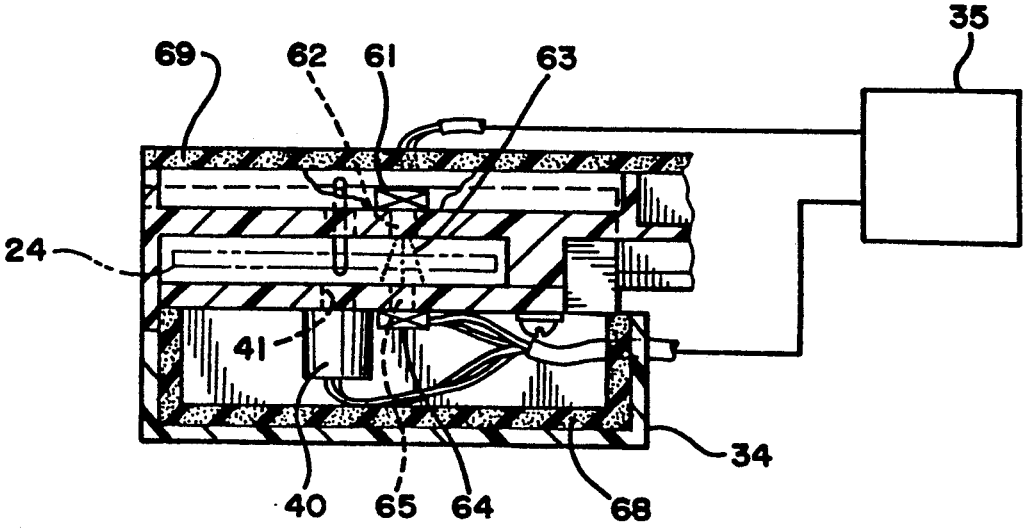
FIG. 4 is a partial sectional view taken along the line 4—4 of FIG. 2 illustrating a coin in the audio sensing zone.

FIGS. 2–4 better illustrate the components mounted within enclosure 34, and their related elements involved in the acoustic testing of coins which enter the coin chute 25. The primary element mounted within enclosure 34 is a sound pickup 40, preferably in the form of a highly directional microphone, mounted adjacent the coin chute 25 and juxtaposed with the test zone 25*a* in the chute. For purposes of rendering the audible test highly sensitive to the intended acoustic response while minimizing response to exterior noises, the microphone 40 is of the highly directional variety, is mounted very near the coin test zone 25*a* of the coin chute, and is coupled to the coin test zone 25*a* by means of a short and very direct aperture 41.

In practicing the invention, an acoustic response is generated in the coin 24 by means of an impact caused by a striker 44 having a protruberance 45 disposed within the coin chute 25 in the test zone 25*a*. As best shown in FIG. 3, the striker 44 is in the form of a bent arm pivoted at 46 which in the solid line normal position has protruberance 45 within the test zone 25*a* for interference with a coin passing down the chute 25. When a coin 24 impacts the protruberance 45 of the striker 44, it is pivoted to the dashed line position, out of the path of coin travel, allowing the coin to continue its travel down the chute 25. The impact of the striker 44 with the coin 24 generates an acoustical response in the coin which is sensed by audio frequency pickup 40 to produce a signal which has been found to be related to the characteristics of the coin. Those characteristics include the size and shape of the coin, and the material from which it was made. The acoustical response generated by impacting the coin and sensing the response in the manner illustrated has been found to be highly selective to tokens used in casino gaming machines and has been found capable of distinguishing valid tokens from invalid counterfeits.

Turning briefly to FIG. 2, there is shown a view of the striker mechanism 44 and its pivot point 46 as comprising a bent spring wire element securely mounted to the base plate 21 by means of a clamp 48 to fix an arm portion 49 of the striker, allowing pivoting of the striker at 46 (out of the plane of the paper) to remove the protruberance 45 from the coin chute when impacted by a coin.

FIG. 3 illustrated that the point of impact of the coin is preferably disposed adjacent the aperture 41 which communicates sound directly to the sound pickup 40. Thus, the audible response in the coin is sensed directly at the point at which it is created, and translated into an electrical signal by the microphone 40 for further processing by circuitry mounted in the circuit board 35. That circuitry will be further described in connection with subsequent figures. Suffice it to say for the moment that the circuitry senses the characteristics of the electrical signal produced by microphone 40, such as the amplitude or frequency characteristic, compares that characteristic to a known standard associated with an acceptable coin, and generates an accept or reject signal used to drive the solenoid 30.

In addition to the very short and direct path between the sensitive and highly directional microphone 40 and the coin at the point of impact, an arrangement which tends to saturate the audio circuit with the audible response at impact, additional means can be utilized if desired to even further isolate the audio pickup circuitry form extraneous noise. Thus, FIG. 4 illustrates sound-absorbing insulation 68 disposed about the interior of housing 30 to surround three sides of the microphone, and further sound insulating material 69 disposed of the portion of the housing 21 opposite the microphone to help prevent entry of extraneous audible information into the sensing zone 25*a*. While the coin mechanism is illustrated in, for example, FIG. 1, as including a relatively short coin chute 25, it will be appreciated by those skilled in the art that the coin mechanism itself is usually located internally of the machine and coupled to the machine coin slot by a rather long passage or coin slot, thus making clear the fact that the entrance 25*b* of the coin mechanism coin chute is usually well separated from the coin slot, providing a further element of sound isolation for the sensing zone 25*a*. If desired, baffle means can be inserted in the coin chute for further providing isolation when such additional isolation is thought necessary.

In accordance with an important aspect of the invention, means are provided for enabling the audio frequency detection circuitry only in the presence of a coin 24 in the test zone 25*a*. To that end, the illustrated embodiment includes optical sensing means indicated generally at 60 adapted to traverse the coin chute 25*a* with a light beam, and to detect the interruption of the light beam as an indication of the presence of a coin in the chute. Thus, mounted on one side of the coin chute (see FIGS. 3 and 4) is a light emitting diode 61 associated with an aperture 62 formed in the housing and so positioned as to direct a light beam generally indicated at 63 into the coin chute 25. Mounted on the other side of the coin chute, opposed to the light emitting diode 61 is a photo detector 64 which is also associated with an aperture 65 and so positioned as to receive light generated by the LED 61 except in the presence of a coin at which time the light beam is interrupted. It is seen that the output leads from the photodetector 64 as well as the output leads from the microphone 40 are combined into cable 37, and thus routed to the control circuitry 35. Thus, whenever a coin 24 interrupts the light beam 63, the change in conductivity of the photodetector 64 produces a signal which is coupled to the control circuitry 35 which, as will be described below, serves to energize the audio sensing or detecting portion of the coin detector circuitry.

While the illustrated embodiment snows the use of only one light emitting diode and one photo receptor, it is of course possible to use multiple detectors positioned strategically across the coin chute, or vertically displaced in the coin chute, for the purpose of not only detecting the presence of a coin but assuring that it is a coin of the correct size. Various configurations of coin presence detectors will suggest themselves to those skilled in the art, and will not be further illustrated in the drawings. Suffice it to say that various means are available for sensing the presence of a coin in the chute and are used in the preferred embodiment of the invention to generate an enabling signal for enabling the sensing and analysis of the audible signals generated by impacting the coin during its passage down the chute.

The alternative dual optical detector may be connected in parallel to avoid the problem of certain smaller diameter coins having a similar acoustical ring. A pair of light emitting diodes 61 and 61*a* (FIG. 6) are mounted on one side of the coin chute and spaced horizontally laterally in front to back fashion in the orientation of FIG. 3.

A pair of photo detectors 64 and 64*a* are mounted on the opposite side of the coin chute and aligned with light emitting diodes 61 and 61*a* to each operate as described above. In this fashion, if a smaller coin having a similar acoustical ring is dropped down the chute, the coin will not block both optical detectors simultaneously, and is in turn rejected.

Figure 5:
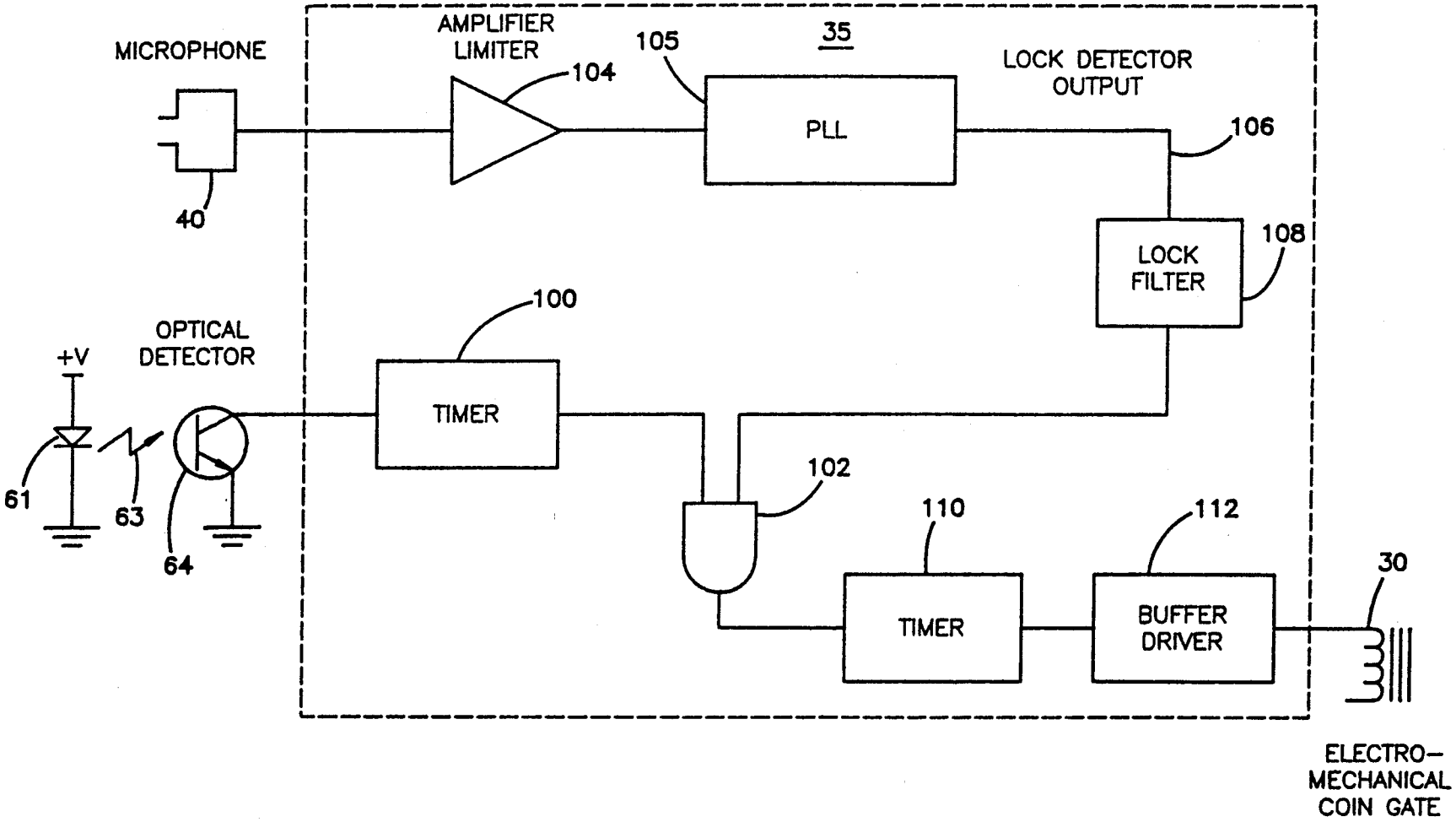
FIG. 5 is a block diagram illustrating one implementation of a circuit embodied in the device of FIG. 1 capable of distinguishing between acceptable and unacceptable coins.

Turning now to FIG. 5, there is shown a block diagram of a circuit configuration utilized to implement a coin detector system exemplifying the present invention. The directional microphone 40 is illustrated at the left of the figure and, at the right of the figure is illustrated the solenoid 30 which, when actuated, causes the acceptance of the coin which had been tested. The optical detector 64 is also shown in FIG. 5 as is the light-emitting diode 61.

Turning first to the gating element, it is seen that the light-emitting diode 61 in the illustrated embodiment is normally maintained in the on condition to emit a beam of radiation at the optical detector 64. The optical detector 64 thus provides a continuous signal which-serves as an input to timer circuit 100. When a coin interrupts the light beam 63, the optical detector 64 responds by producing a sharply rising signal triggers the timer 100 to produce an output pulse of predetermined width. The pulse, which persists for a predetermined interval after detection of the leading edge of the coin, is coupled as one of the two inputs to AND gate 102.

The microphone 40 has an output line coupled to an amplifier limiter 104 which in turn is coupled as an input to a phase locked loop 105. The limiter 104 tends to remove amplitude variations from the signal produced by microphone 40, and the phase locked loop 105 compares the frequency of the input signal with a standard frequency known to be associated with an acceptable coin. As will be more completely described below, the standard in the case of the phase locked loop implementation is established by the frequency selective elements coupled to the phase locked loop integrated circuitry. In one embodiment, the phase locked loop is selected to have a lock range encompassing the frequency band from 5900 Hz to 6900 Hz. When a frequency of that signal is produced at the microphone 40 and coupled through the amplifier limiter 104, the phase locked loop will sense that frequency and produce a signal at the output 106 thereof having a logic level indicating that an inband frequency has been detected. A lock filter 108 is provided to prevent the system from responding to noise, such as a white noise input which would have a minor component in the desired frequency range. Thus, with the phase locked loop 105 and lock filter 108 configuration as illustrated in FIG. 5, a signal having a strong component in the acceptable frequency range will produce a high signal at the output of lock-filter 108 which is coupled as a second input to AND gate 102. The two high signals, that produced by the optical detector, and that produced by the audio sensing circuitry, when concurrently present, satisfy AND gate 102 which triggers a timer 110 to cause the production of a pulse output. The pulse output is coupled to a buffer driver 112 which energizes the solenoid 30 for the duration of the pulse. The pulse period is selected to be adequate to energize the solenoid 30 to transport the coin accepting deflector into the coin chute prior to the time the coin reaches the accept/reject position, to maintain the accept deflector in position until the coin has been deflected into the accept slot, then to promptly remove the accept deflector from the coin chute in preparation for passage of the next coin.

Attention is directed to the fact that AND gate 102 requires both activation of the enabling means (in the illustrated embodiment by the optical detector) in conjunction with a substantial signal from the audio detector circuitry before the solenoid 30 is energized. Thus, in the absence of a coin in the slot, even if one tampering with the device imposes an audio frequency signal on the system which has a substantial component within the desired range, no output will be provided because of the lack of enablement by the coin presence detector. Similarly, if a coin traverses the chute to satisy the optical detector enabling circuitry, the coin will shortly thereafter impact the striker means causing an audible signal tending to saturate the microphone 40 and amplifier limiter circuit 104. If the coin is of the proper denomination, the saturated audio circuitry will cause the passage of-the coin. However, if the coin is not of the proper determination, a strong audio frequency component will be produced in the microphone 40 which will tend to override extraneous audio frequency signals, tending to cause the system of FIG. 5 to reject the coin. Thus, provision is made for those who would attempt to defeat the system by utilizing an audio frequency sound source without a coin, and those who would also use a token or other means or triggering the enabling means but one which does not produce an audio response having the desired characteristic. Coin tester 20 may further include a magnetic coin sensor (not shown) for comparing the magnetic characteristics of the tested coin against an acceptable magnetic characteristic, and means for combining an output of the magnetic coin sensor with the coin sensing and enabling circuitry in order to determine acceptability or unacceptability of the tested coin or token on the basis of both audio frequency and magnetic properties of the tested coin.

Figure 6:
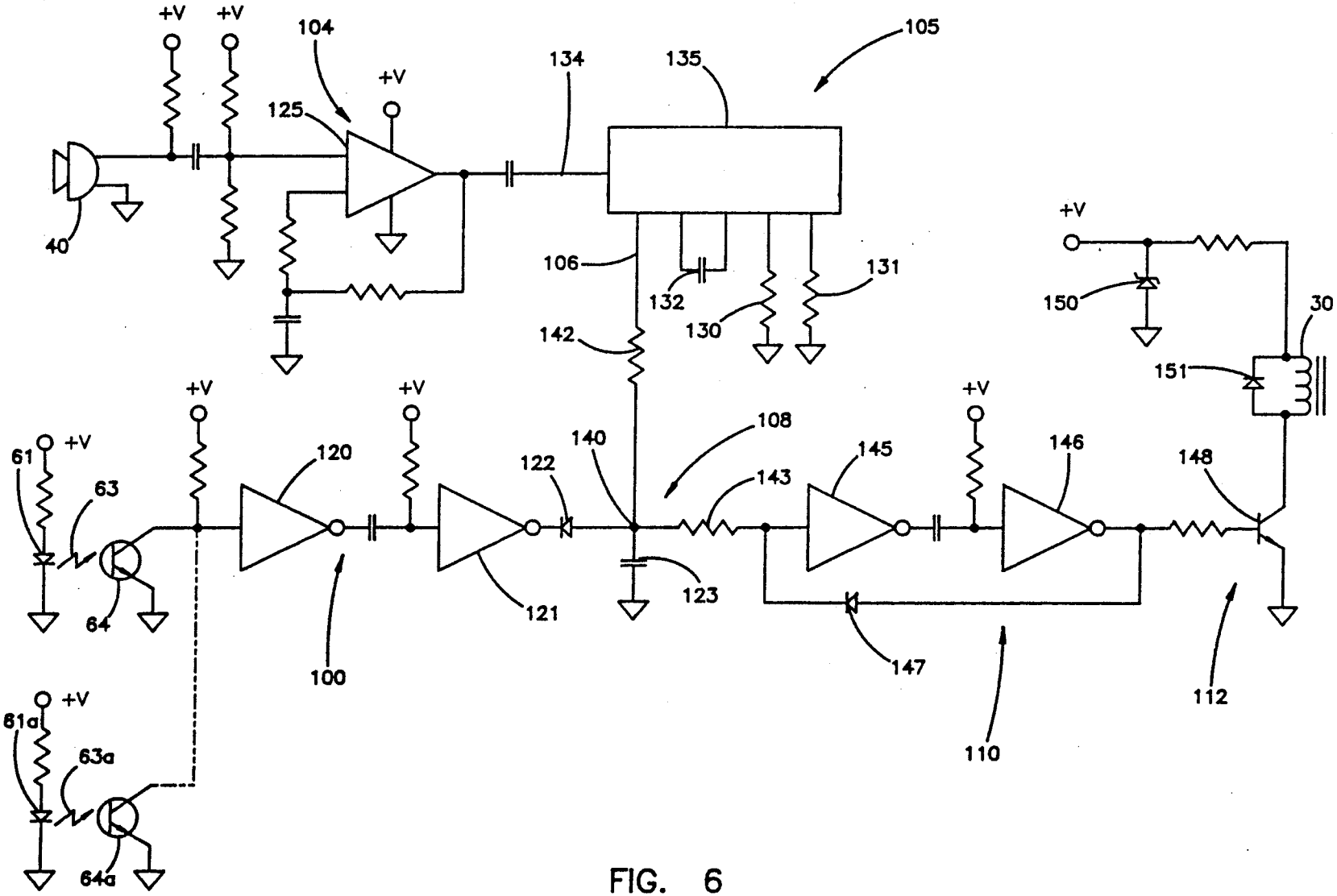
FIG. 6 is a more detailed schematic diagram of the circuit of FIG. 5.

FIG. 6 illustrates a circuit diagram for implementing the block diagram of FIG. 5. Turning first to the coin sensing and enabling circuitry, the forward biased LED 61 is illustrated in the lower lefthand portion of the diagram. The light beam 63 impinges on the photodetector 64 which is coupled as an input to an inverter 120 comprising one of the elements of timer 100. Timer 100 includes inverter 120, a second inverter 121, and associated resistors and capacitors which produce at the output of inverter 121 a positive going narrow pulse each time a coin interrupts the light beam 63. At all other times, the output of inverter 121 is maintained in a logic low condition, forward biasing a diode 122 to maintain a capacitor 123 (which is an element of lock filter 108) in the discharged condition. However, when a coin breaks the light beam 63, the output of inverter 121 switches briefly high, allowing capacitor 123 to be discharged if an appropriate audio signal is detected.

For purposes of producing an audio frequency signal having characteristics corresponding to the audio response of the impacted coin, the microphone 40 is coupled to amplifier limiter 104. The resistive capacitive networks associated with an amplifier 125, which forms the amplifying element of the amplifier limiter 104, establish the operating point of the amplifier 125 in the audio frequency range and provide adequate feedback to the amplifier such that it tends to saturate in response to audio signals picked up by the microphone 40. Thus, amplitude variations in the illustrated embodiment are removed from the output of amplifier 125, with the audio frequency variations preserved for analysis by the phase locked loop 105. The phase locked loop includes an integrated circuit 135, preferably a CMOS circuit commercially available as part No. MC 14046. The resistors 130, 131 and capacitor 132 establish the frequency range at which the phase locked loop 105 will respond. Frequencies within the selected range (e.g., 5900–6900 Hz) are coupled on an input 134 of the phase locked loop chip 135 tend to produce a high logic signal on the output 106 which is coupled to a node 140, which serves as the AND gate 102 of FIG. 5 The lock filter comprises the aforementioned capacitor 123 along with resistors 142, 143 which tend to allow the capacitor 123 to be charged to a high level in the presence of a substantial signal picked up by the microphone 40 in the selected frequency band to which the phase locked loop 105 is set to respond In the presence of such a signal, the node 140 is brought to a logic high, and that logic high is coupled through resistor 143 to an input of amplifier 145 which serves as one element of timer circuit 110. The other active element of that timer circuit is amplifier 146 having an output which is coupled back through a diode 147 to the input of amplifier 145. The resistor and capacitor elements of that network cause the production of a positive pulse of predetermined width at the output of amplifier 146 whenever the input to amplifier 145 switches high as a result of charging capacitor 123. The positive pulse at the output of amplifier 146 switches a transistor 148 to the on state. The transistor 148 is the active element of driver circuitry 112. Switching on of the transistor 148 draws current through the solenoid coil 30 energizing the solenoid to accept the coin. Xener diode 150 is coupled in the circuit to prevent spikes generated by the solenoid from damaging other components, whereas diode 151 is coupled across the solenoid coil 30 to suppress surges.

In summary, it is seen that when a coin traverses the coin chute, the light beam 63 causes the production of a high going signal ar the output of amplifier 121 to reverse bias diode 122. That condition allows capacitor 123 to charge if a charging signal is present. That charging signal is provided by the audio detecting circuitry. The microphone 40 is positioned to pick up an audio response generated by the coin in the chute upon its impact with the striker. If that signal has a substantial component in the selected frequency range of the phase locked loop 105, the output 106 of that phase locked loop causes the charging of capacitor 123 which in turn triggers the timer 110 to produce a pulse at the driver 112, energizing the solenoid 30 and accepting the coin.

FIGS. 5 and 6 illustrate the preferred implementation of the invention where the audio frequency response of an acceptable coin is determined, and then the phase locked loop circuitry 105 configured to respond to that frequency range. It is also possible and may be preferred in some instances to respond to the frequency of the signal by means other than a phase locked loop. More particularly, in some instances it may be preferred to operate on strictly digital principles and to store in a digital memory a frequency characteristic for an acceptable signal, and to compare that digitally stored signal with a digitized version of the audio frequency response of the impacted coin to determine the acceptability or unacceptability of a tested coin.

Figure 7:
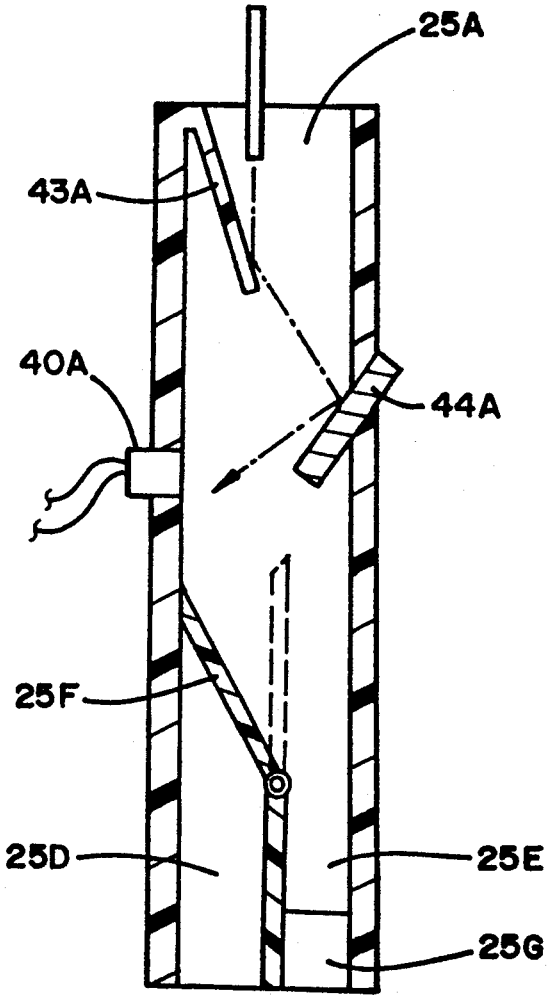
FIG. 7 is a partial sectional view of an alternative preferred embodiment of the invention.

Another alternative preferred embodiment is shown in FIG. 7. In FIG. 7 the coin chute **25*c* has a convoluted path formed by a ramp guide 43*a* and striker plate 44*a*. Striker plate 44*a* is a block of steel that is rubber shock mounted on the chute wall to avoid vibrations back into the mechanism. The coin first strikes ramp 43*a* in order to assume an angled trajectory toward striker plate 44*a*. Upon striking striker plate 44*a*, the coin is solidly rung and bounced back into the chute. Due to the downward angle of striker plate 44*a*, the coin pivots about the coin's center of mass. At the point at which the coin is adjacent sound pickup 40*a*, neither the leading edge nor trailing edge of the coin is in contact with the walls of coin chute 25c**, and a true ring is detected. This provides for consistently accurate ringing of the coin. After a matching ring has been detected, the coin may strike the opposite wall of the coin chute without causing a detecting error in the mechanism. This avoids the problem of a coin accidentally contacting the walls of the coin chute and damping the acoustical ring at the moment of sensing and thus causing an erroneous signal.

Beneath striker plate 44a the coin chute 25c is split into two lower chute sections 25d and 25e. A directing gate 25f is pivotally mounted and a pivoting mechanism pivots gate 25f. Gate 25f is positioned in a normally angled reject condition blocking lower chute section 25d, and is pivoted to a vertically oriented accepted position (shown in phantom) that opens coin accepting lower section 25d. The pivoting mechanism may be a solenoid, an electromagnetically attracted armature, or other suitable means. A spring returns gate 25f to the normally angled reject position.

Upon detection of a matching true ring, gate 25f is shifted to the open position, and the coin falls into accepted coin chute section 25d. Upon detection of a slug or improper coin, gate 25f remains in the reject position, and the coin is directed by gate 25f into the rejected chute section 25e. A reject ramp 25g is downwardly angled and spring mounted at the lower end of rejected chute section 25e. Ramp 25g redirects the coin forward to the rejected coin exit. The spring loading damps against unduly large impact shocks which may jar the mechanism.

It will now be appreciated that what has been provided is an improved coin detector circuit in which the audio frequency response of a coin is generated by briefly impacting the coin in its traverse down the coin chute, picking up the audio frequency response of the coin in such a way as to minimize the effect of extraneous noise while maximizing the ability to pick up the actual coin response, then analyzing a characteristic of the signal corresponding to the audio frequency response to determine if the coin is acceptable or a counterfeit Preferably, the circuit analyzes frequency content of the signal generated by the audio frequency pickup to produce an accept signal when the frequency content matches that of an acceptable coin Preferably, gating means are provided to enable the audio detector only in the presence of a coin in the chute to further limit tampering with the device.

What is claimed is:

1. A coin tester for discriminating between acceptable and unacceptable coins and tokens as they traverse a coin chute, the coin tester comprising:

a striker for impacting the coin or token in its traverse to cause a characteristic audio frequency response in the coin, audio frequency pickup means enabled to sense the audio frequency response of the coin for producing a signal related thereto, signal processing means for analyzing the signal produced by the pickup means to determine the acceptability or unacceptability of the coin impacted by the striker; and a deflector upstream of said striker, said deflector positioned to deflect a leading edge of a coin in an angled trajectory laterally of the face of the coin toward said striker, wherein said leading edge will contact said striker to ring said coin.

2. The combination as set forth in claim 1 further including gate means associated with the audio frequency pickup means for enabling said pickup means in the presence of a coin traversing the chute.

3. The combination as set forth in claim 1 in which the signal processing means includes means for analyzing the frequency characteristics of the signal produced by the audio frequency pickup means.

4. The combination as set forth in claim 3 wherein the signal processing means further includes an amplitude limiter and a frequency discriminator responsive to a predetermined frequency range, the predetermined frequency range being related to the audio frequency response of an acceptable coin.

5. The combination as set forth in claim 4 wherein the frequency discriminator includes a phase locked loop responsive to said predetermined frequency range.

6. The combination as set forth in claim 4 wherein the frequency discriminator includes a memory storing a desired frequency response of an acceptable coin, and means for comparing the frequency response of a tested coin to the stored response for determining acceptability of a tested coin.

7. The combination as set forth in claim 2 in which the gate means comprises an optical sensor having a sensing path in the coin chute and adapted to be activated by the passage of a coin through the sensing path.

8. The combination as set forth in claim 1 wherein the signal processing means includes means for storing a characteristic response for an acceptable coin, and means for comparing a sensed characteristic derived from the analyzed signal with the stored characteristic to determine acceptability of the coin.

9. The combination as set forth in claim 8 wherein the means for storing a characteristic response comprises a phase locked loop for comparing the frequency characteristic of said signal with a predetermined frequency characteristic to determine acceptability of the coin.

10. The combination as set forth in claim 8 wherein the means for storing comprises a memory for storing a characteristic response of an acceptable coin.

11. The combination as set forth in claim 8 wherein the signal processing means includes for storing a plurality of acceptable characteristic responses associated with a plurality of acceptable coins, and the means for comparing includes means for comparing the sensed characteristic derived from the analyzed signal with a selected one of the plurality of stored characteristics.

12. The combination as set forth in claim 1 wherein the frequency pickup comprises a microphone having a directional characteristic, and means for mounting the microphone at the coin chute in a position where it is juxtaposed to the coin at the point of impact, thereby to maximize coupling of the audio frequency response of the tested coin to the audio frequency pickup.

13. The combination as set forth in claim 12 further including sound absorption means for isolating the microphone and coin at its point of impact to minimize extraneous noise pickup by the microphone.

14. The combination as set forth in claim 1 wherein said striker is adapted to impacting a face edge of the coin or token and pivoting the coin or token about its center of mass.

15. The combination as set forth in claim 1 wherein said striker is rubber shock mounted.

16. A coin tester for discriminating between acceptable and unacceptable coins and tokens as they traverse a coin chute, the coin tester comprising:

a striker for impacting the coin in its traverse to cause a characteristic audio frequency response in the coin, audio frequency pickup means enabled to sense the audio frequency response of the coin for producing a signal related thereto, signal processing means for analyzing the signal produced by the pickup means to determine the acceptability or unacceptability of the coin impacted by the striker; and wherein the striker comprises a projection interposed in the coin chute and positioned for impact by the coin traversing the chute, the projection being deflectable such that a coin upon impacting the projection displaced the projection out of its path for continued traverse of the chute.

17. The combination as set forth in claim 16 further including gate means associated with the audio frequency pickup means for enabling said audio frequency pickup means in the presence of a coin traversing the chute.

18. The combination as set forth in claim 17 in which the gate means comprises an optical sensor having a sensing path in the coin chute and adapted to be activated by the passage of a coin through the sensing path.

19. The combination as set forth in claim 16 in which the signal processing means includes means for analyzing the frequency characteristics of the signal produced by the audio frequency pickup means.

20. The combination as set forth in claim 19 wherein the signal processing means further includes an amplitude limiter and a frequency discriminator responsive to a predetermined frequency range, the predetermined frequency range being related to the audio frequency response of an acceptable coin.

21. The combination as set forth in claim 20 wherein the frequency discriminator includes a phase locked loop responsive to said predetermined frequency range.

22. The combination as set forth in claim 20 wherein the frequency discriminator includes a memory storing a desired frequency response of an acceptable coin, and means for comparing the frequency response of a tested coin to the stored response for determining acceptability of a tested coin.

23. The combination as set forth in claim 16 wherein the signal processing means includes means for storing a characteristic response for an acceptable coin, and means for comparing a sensed characteristic derived from the analyzed signal with the stored characteristic to determine acceptability of the coin.

24. The combination as set forth in claim 23 wherein the means for storing a characteristic response comprises a phase locked loop for comparing the frequency characteristic of said signal with a predetermined frequency characteristic to determine acceptability of the coin.

25. The combination as set forth in claim 23 wherein the means for storing comprises a memory for storing a characteristic response of an acceptable coin.

26. The combination as set forth in claim 23 wherein the signal processing means includes for storing a plurality of acceptable characteristic responses associated with a plurality of acceptable coins, and the means for comparing includes means for comparing the senses characteristic derived from the analyzed signal with a selected one of the plurality of stored characteristics.

27. The combination as set forth in claim 16 wherein the frequency pickup comprises a microphone having a directional characteristic, and means for mounting the microphone at the coin chute in a position where it is juxtaposed to the coin at the point of impact, thereby to maximize coupling of the audio frequency response of the tested coin to the audio frequency pickup.

28. A method of discriminating between acceptable and unacceptable coins and tokens as they traverse a coin chute, the method comprising the steps of:

causing an impact on a face portion of a leading edge of a tested coin or token during traverse of the tested coin or token to produce an audio frequency response resulting from the impact by laterally deflecting the leading edge in the path of traverse of the tested coin or token into striking said face portion of said leading edge of the tested coin or token to ring and pivot the test coin or token about its face plane, producing an electrical signal related to the audio frequency response resulting from the impact, and analyzing the electrical signal with respect to a characteristic related to an acceptable coin to determine the acceptability or unacceptability of the tested coin or token.

29. The method as set forth in claim 28 further including the step of gating the electrical signal in such a way that the analysis step is performed only in the presence of a coin in the coin chute.

30. The method as set forth in claim 29 further including the step of sensing the presence of a coin prior to coin impact, and enabling the production or analysis of the electrical signal only in the presence of a sensed coin.

31. The method as set forth in claim 28 wherein the analysis step comprises analyzing the frequency content of the electrical signal to determine if the frequency content is within a range associated with an acceptable coin.

32. The method as set forth in claim 29 wherein the analysis step comprises analyzing the frequency control of the electrical signal to determine if said frequency content is within a range associated with an acceptable coin.

33. The method as set forth in claim 28 further including the step of storing information related to a characteristic response of an acceptable coin, and the analysis step comprises comparing a characteristic derived from the electrical signal with the stored characteristic to discriminate between acceptable and unacceptable coins.

34. The method as set forth in claim 33 wherein the step of storing comprises storing a plurality of characteristic responses associated with a plurality of acceptable coins, and the step of analysis further comprises comparing the characteristic derived from the electrical signal with a selected one of the plurality of stored characteristics to discriminate between acceptable and unacceptable coins.

35. The method as set forth in claim 28 further including the step of optically monitoring the coin chute to sense traverse of a coin through the chute, and enabling the signal production or analysis after sensing the presence of a coin in the chute.

36. A coin tester for discriminating between acceptable and unacceptable coins and tokens as they traverse a coin chute, the coin tester comprising:

a coin chute adapted for the entry and traversing by the coin, said coin chute having chute walls and a pickup zone at which said coin chute is dimensioned and configured to accommodate the coin with the coin out of contact with said chute walls;

a striker disposed in said coin chute, said striker having a striking surface angled away from the plane defined by the face of a coin traversing the coin chute in order to pivot the coin and disposed to be impacted by the coin and cause a characteristic audio frequency response in the coin as said coin is disposed at said pickup zone;

a deflector disposed in said coin chute upstream of said striker said deflector disposed to deflect a leading edge of a coin toward said striking surface wherein said leading edge will contact said striker to ring said coin;

audio frequency pickup means enabled to sense the audio frequency response of the coin at said pickup zone for producing a signal related thereto; and signal processing means for analyzing the signal produced by said pickup means to determine the acceptability or unacceptability of the coin impacted by said striker.

37. The coin tester of claim 36, wherein said signal processing means includes means for analyzing the frequency characteristics of the signal produced by said audio frequency pickup means.

38. The coin tester of claim 37, wherein said signal processing means further includes an amplitude limiter and a frequency discriminator responsive to a predetermined frequency range, the predetermined frequency range being related to the audio frequency response of an acceptable coin.

39. The coin tester of claim 36, wherein said signal processing means includes means for storing a characteristic response for an acceptable coin and means for comparing a sensed characteristic derived from the analyzed signal with the stored characteristic to determine acceptability of the coin.

* * * * *

UNITED STATES PATENT AND TRADEMARK OFFICE

CERTIFICATE OF CORRECTION

PATENT NO. : 5,226,520
DATED : July 13, 1993
INVENTOR(S) : DONALD O. PARKER

It is certified that error appears in the above-identified patent and that said Letters Patent is hereby corrected as shown below:

Column 2, line 5
"or an" should be --of an--

Column 2, line 21
"as the" should be --as they--

Column 2, line 21
After "chute" insert --.--

Column 2, line 49
"use or" should be --use of--

Column 2, line 61
"snowing" should be --showing--

Column 3, line 29
After "20" insert --.--

Column 3, line 33
After "unacceptable" insert --.--

Column 3, line 37
After "acceptable" insert --.--

Column 4, line 40
"illustrated" should be --illustrates--

Column 6, line 10
"element" should be --elements--

UNITED STATES PATENT AND TRADEMARK OFFICE

CERTIFICATE OF CORRECTION

EST AVAILABLE COPY

PATENT NO. : 5,226,520
DATED : July 13, 1993
INVENTOR(S) : DONALD O. PARKER

It is certified that error appears in the above-identified patent and that said Letters Patent is hereby corrected as shown below:

Column 6, lines 66 and 67
"conlunction" should be --conjunction--

Column 8, line 3
After "FIG. 5" insert --.--

Column 8, line 3
After "filter" insert --108--

Column 8, line 9
After "respond" insert --.--

Column 8, line 31
"ar the" should be --at the--

Column 9, lines 41 and 42
After "counterfeit" insert --.--

Column 9, line 45
After "coin" insert --.--

Column 11, line 15, claim 16
"displaced" should be --displaces--

UNITED STATES PATENT AND TRADEMARK OFFICE

CERTIFICATE OF CORRECTION

PATENT NO. : 5,226,520

DATED : July 13, 1993

INVENTOR(S) : Donald O. Parker

It is certified that error appears in the above-indentified patent and that said Letters Patent is hereby corrected as shown below:

Column 11, line 64, claim 26
"senses" should be --sensed--.

Signed and Sealed this

Twenty-eight Day of March, 1995

Bruce Lehman

*Attest:*

BRUCE LEHMAN

*Attesting Officer*

*Commissioner of Patents and Trademarks*